US006283818B1

(12) United States Patent
Kushner et al.

(10) Patent No.: US 6,283,818 B1
(45) Date of Patent: Sep. 4, 2001

(54) TOY BUILDING SET

(75) Inventors: Philip Marshall Kushner, Windsor (GB); Kaj Mikkelsen, Billund (DK)

(73) Assignee: INTERLEGO AG, Baar (CH)

( * ) Notice: Subject to any disclaimer, the term of this patent is extended or adjusted under 35 U.S.C. 154(b) by 0 days.

(21) Appl. No.: 09/254,884

(22) PCT Filed: Sep. 16, 1997

(86) PCT No.: PCT/DK97/00389

§ 371 Date: Oct. 28, 1999

§ 102(e) Date: Oct. 28, 1999

(87) PCT Pub. No.: WO98/11966

PCT Pub. Date: Mar. 26, 1998

(30) Foreign Application Priority Data

Sep. 17, 1996 (DK) ..... 1009/96

(51) Int. Cl.[7] ..... A63H 33/00

(52) U.S. Cl. ..... 446/476; 446/118; 434/72

(58) Field of Search ..... 446/71, 80, 82, 446/118, 476, 478, 479, 487, 488, 85; 434/72, 75

(56) References Cited

U.S. PATENT DOCUMENTS

| | | | | |
|---|---|---|---|---|
| 2,559,261 | | 7/1951 | Schwartz . | |
| 3,534,494 | | 10/1970 | Majima . | |
| 4,227,337 | * | 10/1980 | Murray et al. | 446/118 |
| 4,270,302 | * | 6/1981 | Dandia | 446/118 |
| 5,733,165 | * | 3/1998 | Kelley | 446/71 |
| 5,779,517 | * | 7/1998 | Clarke | 446/118 |
| 5,890,338 | * | 4/1999 | Rodriguez-Ferre | 446/476 |
| 5,938,566 | * | 8/1999 | Rodriguez-Ferre | 446/476 |

FOREIGN PATENT DOCUMENTS

| | | |
|---|---|---|
| 1 013 553 | 8/1957 | (DE) . |
| 2 042 017 | 9/1980 | (GB) . |
| 2 151 933 | 7/1985 | (GB) . |

* cited by examiner

*Primary Examiner*—Sam Rimell
(74) *Attorney, Agent, or Firm*—Pitney, Hardin, Kipp & Szuch LLP

(57) ABSTRACT

A toy building set comprising walls (1, 2) having at least one door opening (12, 13) which extends from the lower edge (15, 16) of the walls (1, 2,) and upwards in the position of use of the walls (1, 2) at a height and with a width corresponding to a door, said toy building set additionally comprising at least one door element (10) and one window element (2, 3), said toy building set comprising a door frame (11) which has a height and a width corresponding to the door opening (12, 13), said door frame (11) having coupling means for releasable, fixed mounting of the door frame in the door opening by means of complementary coupling means (17, 25) located at the wall opening (12, 13), said door element (10) having hinge parts (26) for releasable mounting in complementary hinge parts in the door opening (12, 13) or the door frame (11), said toy building set additionally comprising at least one window frame (8, 9) which has a width and a height corresponding to the width and the height of the door frame (11), said window frame (8, 9) having coupling means (20, 21) for releasable, fixed mounting in the door opening (12, 13). This provides a high degree of flexibility with respect to the positioning of windows and doors in a toy building, thereby making it easy to build and vary between many different buildings in a rapid manner and with few subcomponents.

10 Claims, 3 Drawing Sheets

TOY BUILDING SET

The present invention concerns a toy building set comprising walls having at least one door opening which extends from the lower edge of the walls and upwards in the position of use of the walls at a height and in a width corresponding to a door, said toy building set additionally comprising at least one door element and onewindow element.

Toy building sets used for the construction of toy buildings, such as doll's houses, are known today in numerous embodiments, all of which provide the possibility of flexibly constructing many different buildings in contrast to the traditional well-known, non-flexibly built doll's houses.

Thus, e.g. GB-A-2 042 017 and U.S. Pat. No. 2,559,261 disclose a building set including loose building elements comprising separate windows, door and wall elements of different sizes. These separate elements may be combined in many different ways with respect to the construction of different types of buildings. However, a drawback of this type of building set is that it takes relatively many elements to construct a given facade. This means that the building set does not lend itself particularly well to children who are primarily interested in playing with the finished building, rather than building it.

DE Auslegeschrift No. 1 013 553, e.g., discloses a building set which to a higher degree allows rapid building of various building facade structures, as this building set comprises facade elements in which doors and windows are integrated in the elements. As the outer dimensions of the facade elements are the same, various positions of these in a building facade structure may be freely selected.

A recurring problem in the development of such toy building systems is to provide systems which on one hand enables flexible building of facade structures, and on the other hand do not necessitate the use of many subcomponents. Accordingly, the object of the present invention is to provide a toy building set of the type mentioned in the opening paragraph, which makes it possible to build many different building facade structures, without this necessitating the use of many individual elements for the building of a given facade structure. This makes the toy building set highly suitable for children who primarily want to play with the finished toy building or the finished doll's house, it being still important to the child that different building facades may be built.

This is achieved by a toy building set as defined in claim 1. The toy building set comprises a door frame having a height and a width which correspond to the door opening, said door frame having coupling means for releasable, fixed mounting of the door frame in the door opening by complementary coupling means located at the wall opening, said door element having hinge parts for releasable mounting in complementary hinge parts in the door opening or the door frame, said toy building set additionally comprising at least one window frame differing in design from, but having a width and a height corresponding to the width and the height of the door frame, said window frame having coupling means for releasable, fixed mounting in the door opening. This provides great freedom with respect to the location of windows in the facade structure, allowing it to be freely decided with respect to the door opening whether it is to be used for the mounting of a window or a door. Additionally, it is ensured that different door frames may be used together with a given door element.

The invention may be used to advantage even in connection with traditional doll's houses having a fixed partitioning and fixed walls, because it allows building of different facades, even though the basic structure per se is inflexible. However, the invention is preferably used in connection with building sets which permit building of various basic structures, as the walls in the toy building set may be interconnected differently.

The window frame may advantageously be formed by the window element and a termination element, said window element in the position of use having a height which is smaller than the height of the door opening, said termination element being constructed so as to be mountable in the door opening at the side of the window element, said termination element and window element together forming the window frame and covering the door opening. Different window elements and termination elements may thus be provided, and these may be freely combined.

The termination element may expediently be constructed to be placed below the window element when these are mounted in the door opening, so that the termination element may form a natural part of the building set, as it can illustrate a window box, a wall or the like.

In a preferred embodiment, the walls additionally have at least one window opening which is provided with complementary coupling means for releasable mounting of a window element in the window opening, said window opening in the position of use extending upwards spaced from the bottom edge of the wall and having a height which corresponds to the height of the window element. The window element may hereby be used alone without using the termination element, which provides additional flexibility with respect to the building of the facade.

Further, the window element and the termination element may have mutually complementary coupling means for releasable coupling of the termination element on the window element, said coupling means on the window element being located so as to be accessible for the mounting of the termination element when the window element is mounted in a window opening. Thus, it is possible to use the termination element in connection with a window opening, which additionally increases the number of alternative possibilities of building facades.

In a further expedient embodiment, the coupling means on the door frame and the window frame are the same, thereby reducing the number of separate coupling means.

Particularly expediently, the coupling means may be formed by protruding coupling studs which extend into the plane of the wall when the door frame or the window frame is mounted on the wall, so that the walls may be formed without protruding coupling parts. Here, the coupling studs may advantageously be formed so as to be mountable on the inwardly extending edges on the door and window openings.

The toy building element may advantageously comprise both window elements which are constructed as substantially plane windows, and other window elements which are constructed as bay windows, said termination element being constructed as a bay wall. Then the same termination element may have different functions, since when being built together with a bay window it forms a finished bay, and when being built together with a plane window it may serve as a window box or the like.

Additionally, the termination element may expediently be provided with shelves, drawers or the like on the side facing toward the plane of the wall when the termination element is mounted on the wall. When the termination element is mounted together with a window element in a door opening, the shelves or the drawers will be accessible so that the termination element provides further building flexibility.

The invention will be described more fully below and in a preferred embodiment with reference to the drawing, in which.

Figure 1:
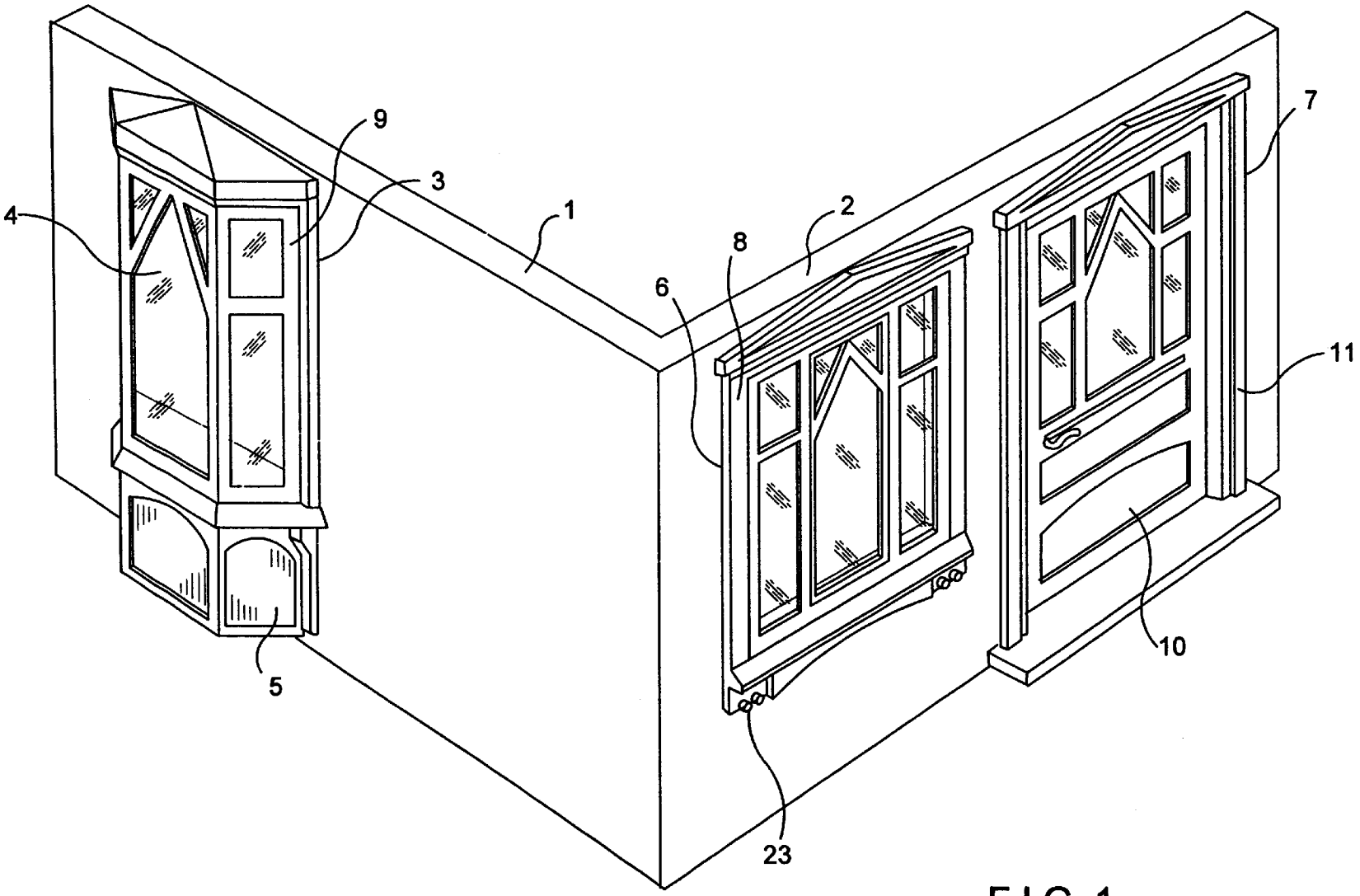
FIG. 1 shows a building with window and door elements according to the invention.

FIG. 1 shows a building consisting of two wall sections 1, 2. One wall section 1 is provided with a removable bay 3 comprising a bay window 4 and a bay breast 5. The other wall section 2 is provided with a removable plane window 6 and a door 7.

The building is here formed by two wall sections 1, 2 which are assembled to a unit. According to the invention, the building may alternatively constitute a complete building, such as a doll's house or the like. Alternatively, the corner structure may advantageously be composed of individual walls which may be combined in different ways to construct a building, such as in connection with facade elements described in the applicant's Danish Patent Application No. 1298/95, which is hereby incorporated by reference. This embodiment of the invention allows construction of toy buildings of different types.

The bay window 4 and the plane window 6 comprise a plane window frame 8 and a bay window frame 9 in which window elements are formed. The bay window frame 9 comprises the bay breast 5. It will be explained later with reference to FIG. 4 how the bay breast 5 may be removable with respect to both the bay window frame 9 and the plane window frame 8.

The door 7 is formed by a door panel 10 hinged with respect to the wall section 2 and a door frame 11. It will be explained later in connection with FIG. 3 how the door elements 10, 11 can be mounted in the wall section 2.

Figure 2:
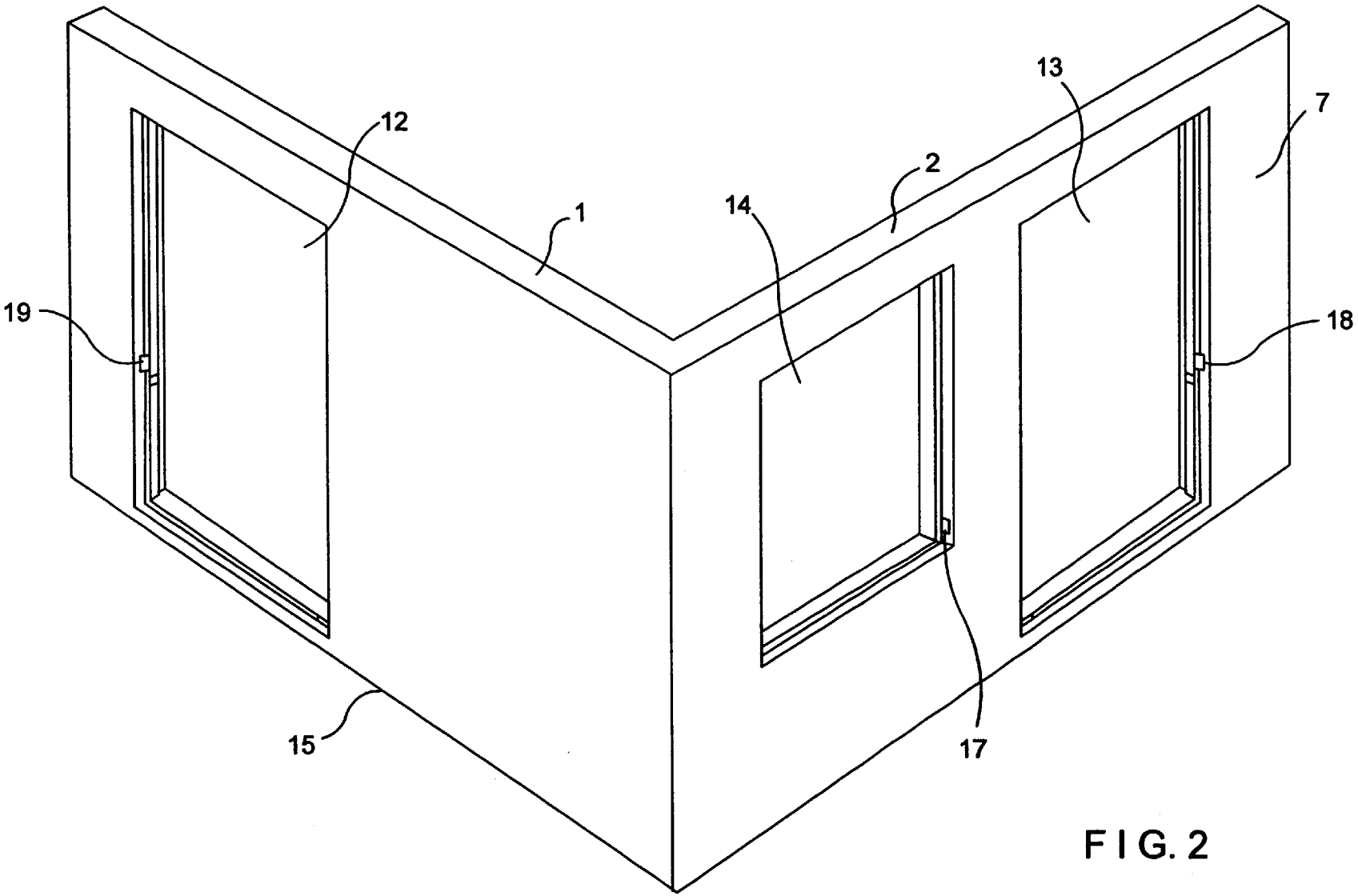
FIG. 2 shows the same building as is shown in FIG. 1, but without window and door elements.

FIG. 2 shows the same building comprising the wall sections 1, 2. However, the building is shown without the removable windows and doors 3, 6, 7, it being seen that the bay 5 comprising the bay window 4 and the bay breast 5, in FIG. 1, together cover a wall opening 12 which extends right from the lower edge 15 of the wall section 1. Similarly, it will be seen that the door 7 comprising the door panel 10 and the door frame 11, in FIG. 1, covers a door opening 13 corresponding to the door opening 12. It will moreover be seen that the plane window 6 in FIG. 1 covers a window opening 14 which extends upwards spaced from the lower edge 16 of the wall section 2.

The window opening 14 is provided with coupling openings 17 for releasable mounting of the plane window 6. Coupling openings identical with the coupling openings 17 in the window opening 14 with respect to height location and with respect to function and possibly shape are provided in the door openings 12 and 13 and are designated 18 and 19 there. Further, the window opening 14 and the door openings 12, 13 are formed with same width.

Figure 3:
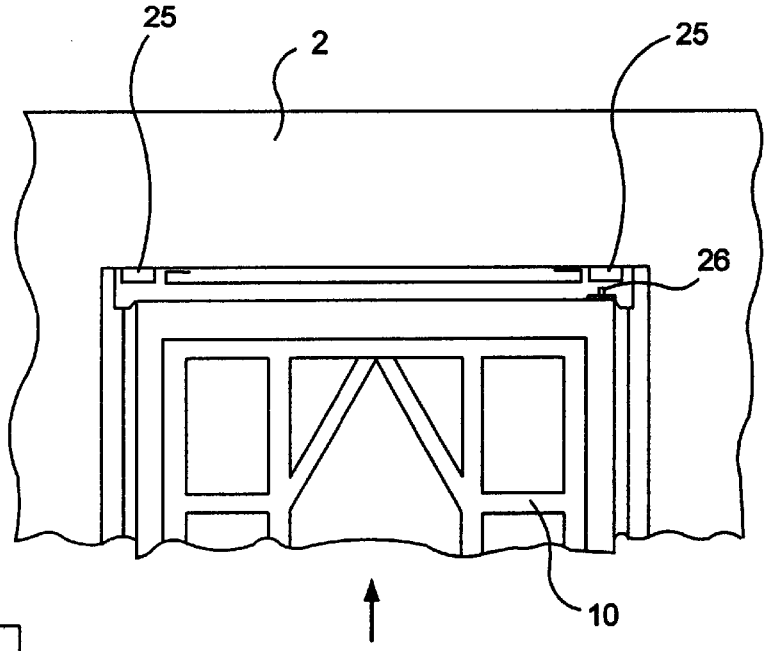
FIG. 3 is a fragmentary view showing the mounting of the door in the building.

Because of the identity of the coupling openings 17, 18, 19 and the identical width of the door 12, 13 and window 13 openings, the plane window 6 may be located at the top in one of the door openings 12, 13 and cover the uppermost part of these according to the invention. The principle of the mounting of the plane window 6 in a window opening 14 is seen in this connection in FIG. 4, which shows that the plane window 6 is provided with releasable snap lock means 20, 21, which may be inserted into said coupling openings 17 and into coupling openings 22 located at the top in the window opening 14. The coupling openings 22 are also provided in the door openings 12, 13 with the same location, as shown in FIG. 3, said openings being designated 25 there.

Figure 4:
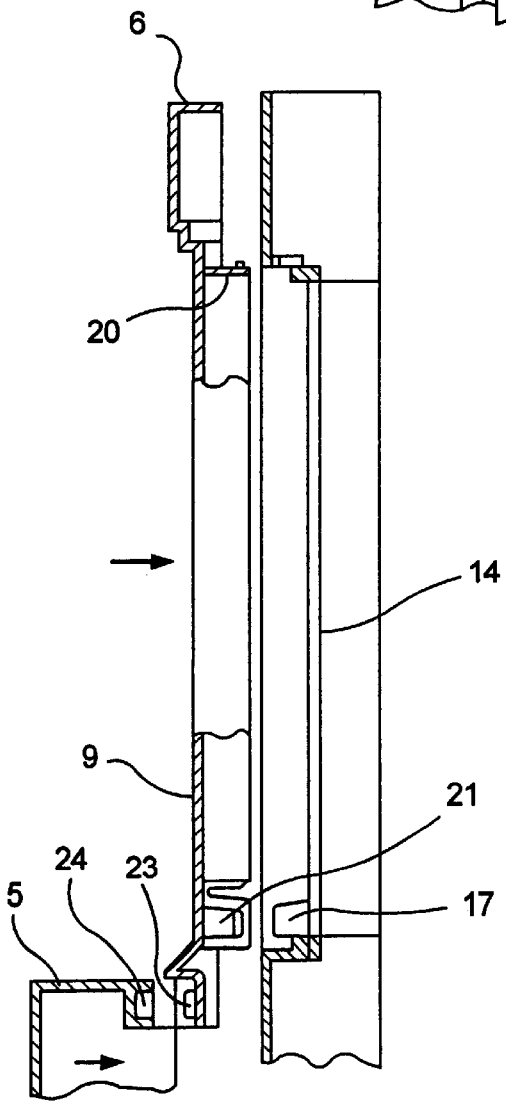
FIG. 4 is a fragmentary sectional, exploded view showing the mounting of the window elements in the building.

In this connection, the door frame 11 and the bay window frame 9 have releasable snap lock means (not shown) corresponding to the snap lock means 20, 21 on the plane window 6 shown in FIG. 4, and with the same position with respect to the upper edge on the bay window frame 9 and the door frame 11.

FIG. 4 is a sectional view of the upper part of a bay breast 5, which is provided with coupling holes 24 adapted to be frictionally and releasably connected with the coupling studs 23 on the plane window. A bay breast 5 may hereby be mounted releasably on the plane window 6, and since the bay breast 5, as shown, is constructed so as to extend completely outside the surface of the wall section 2 after mounting, it may be mounted in a door opening 12, 13 as well as in a window opening 14, as shown in FIG. 4.

The bay window frame 9 has coupling studs (not shown) with the same position and shape as the coupling studs 23 on the plane window, so that the bay breast 5 is mounted in the same manner on a bay window 3 as well as on the shown plane window 6. According to the invention, a bay window 3 or a plane window 6 together with a bay breast 5 may optionally cover a door opening 12, 13, as shown particularly in FIG. 1, or a window opening, as shown in FIG. 4.

It will thus be seen that, according to the invention, it is possible to place windows in all openings 12, 13, 14 in the building, as a window placed in a door opening 12, 13 is supplemented with a bay breast. It is clear in this connection that, according to the invention, the bay breast may be formed by another type of breast, such as a plane breast or a breast which is provided with additional window elements.

FIG. 3 shows a portion of a door opening 12, 13, seen from the front, a door panel 10 being mounted without the associated door frame 11. It will be seen that the door 10 is pivotally mounted in the wall section by means of a pivot 26, so that the door functions without the associated door frame 11 shown in FIG. 1. Various door frames 11 may thus be used for the same door panel 10.

Clearly, the shown embodiment of the invention is not restrictive for the interpretation of the patent claims. It is possible for the skilled person to provide numerous alternative embodiments without departing from the basic idea of the invention. Thus, according to the invention, it is possible to use walls which just have door openings and no window openings, and both the shape and the function of windows and doors and their subcomponents may be varied within wide limits.

What is claimed is:

1. A toy building set comprising wall sections (1, 2) having at least one door opening (12, 13) which extends upwards from a lower edge (15, 16) of the wall sections (1, 2) in a position of use from the wall sections (1, 2), said door opening having a height and a width within said wall sections, said toy building set additionally comprising at least one door element (10) and one window element, wherein the toy building set comprises a door frame (11) having a height and width which correspond to the height and width of the door opening (12, 13), said door frame (11) provided with coupling means for releasable, fixed mounting of the door frame in the door opening that are complementary with coupling means (17, 25) provided at the door opening (12, 13), said door element (10) having hinge parts (26) enabling releasable connection of the door element to complementary hinge parts provided in the door opening (12, 13) or in the door frame (11), said toy building set additionally comprising at least one window frame (9) having a width and a height corresponding to the width and height of the door frame (11), said window frame (9) provided with coupling means (20, 21) that are complementary with coupling means provided at the door opening for releasable, fixed mounting thereof in the door opening (12,13).

2. A toy building set according to claim 1, wherein the window frame (8, 9) is formed by a window element (3, 6) and a termination element (5), said window element (3, 6) in a position of use having a height which is smaller than the height of the door opening (12, 13), said termination element (5) being constructed so as to be mountable in the door opening (12, 13) at one side of the window element (3, 6), said termination element (5) and window element (3, 6) together forming the window frame (9) and covering the door opening (12, 13).

3. A toy building set according to claim 2, wherein the termination element (5) is constructed to be placed below the window element (3, 6) when these are mounted in the door opening (12, 13).

4. A toy building set according to claim 2, wherein the wall sections (1, 2) additionally have at least one window opening (14) which is provided with complementary coupling means (17, 22) for releasable mounting of a window element (3, 6) in the window opening (14), said window opening (14) in a position of use extending upwards spaced from the lower edge (15, 16) of the wall section and having a height which corresponds to the height of the window element (3, 6).

5. A toy building set according to claim 4, wherein the window element (3, 6) and the termination element (5) have mutually complementary coupling means (23, 24) for releasable coupling of the termination element (5) on the window element (3, 6), said coupling means (23, 24) on the window element (3, 6) being located so as to be accessible for the mounting of the termination element (5) when the window element (3, 6) is mounted in a window opening (14).

6. A toy building set according to claim 1, wherein the coupling means (20, 21) on the door frame (11) and the window frame (8, 9) are the same.

7. A toy building set according to claim 6, wherein the coupling means (20, 21) are formed by protruding coupling studs which extend into a plane of the wall section (1, 2) when the door frame (11) or the window frame (8, 9) is mounted on the wall section (1, 2).

8. A toy building set according to claim 7, wherein the coupling studs are constructed so as to engage opposed edges on the wall section (1, 2) which defines the door (12, 13) and window (14) openings.

9. A toy building set according to claims 2, wherein toy building set comprises both window elements (8) which are constructed as substantially plane windows, and other window elements (9) which are constructed as bay windows, and in that the termination element (5) is constructed as a bay breast.

10. A toy building set according to claim 9, wherein the termination element (5) is provided with shelves, drawers or the like on the side facing toward a plane of the wall section (1, 2) when the termination element (5) is mounted on the wall section (1, 2).

* * * * *